US006109391A

United States Patent [19]

Tyson

[11] Patent Number: 6,109,391

[45] Date of Patent: Aug. 29, 2000

[54] LADDER SCAFFOLD

[76] Inventor: James Tyson, 317 Sunset La., Prince Frederick, Md. 20678

[21] Appl. No.: 09/316,966

[22] Filed: May 24, 1999

Related U.S. Application Data

[60] Provisional application No. 60/091,460, Jul. 1, 1998.

[51] Int. Cl.[7] ..... E06C 7/16

[52] U.S. Cl. ..... 182/117; 182/122

[58] Field of Search ..... 182/117, 121, 182/122; 248/238

[56] References Cited

U.S. PATENT DOCUMENTS

| | | | |
|---|---|---|---|
| 1,018,043 | 2/1912 | Gaw | 182/117 |
| 1,501,298 | 7/1924 | Armitage | 182/117 X |
| 2,647,676 | 8/1953 | Napiecinski . | |
| 2,910,135 | 10/1959 | Moore | 182/117 X |
| 3,266,593 | 8/1966 | Okie et al. . | |
| 3,491,852 | 1/1970 | Leist . | |
| 3,739,876 | 6/1973 | Goldberg . | |
| 4,941,547 | 7/1990 | Livick . | |
| 5,769,181 | 6/1998 | Gussow et al. | 182/117 X |

FOREIGN PATENT DOCUMENTS

| | | | |
|---|---|---|---|
| 475 531 | 4/1929 | Germany . | |
| 2194983 | 3/1988 | United Kingdom | 182/117 |

*Primary Examiner*—Daniel P. Stodola
*Assistant Examiner*—Hugh B. Thompson

[57] ABSTRACT

A ladder scaffold is suspended from rods inserted through the hollow rungs of a ladder. The ladder scaffold includes at least two ladders, at least two platform braces, and a platform. Each platform brace has three rods, two long members, and two short members. Two of the rods are inserted through the hollow rungs of a ladder. The long members are attached to the ends of one of the rods and extend downwards from the ladder. The short members are attached to the ends of the second rod. The short members extend horizontally from the ladder towards the surface against which the ladders are leaning. The third rod serves as a pivot point between the long members and the short members. The platform is supported by the short members and extends between the ladders. The long and short members can be attached to the rods at various points, so that the platform can be leveled. The ladder scaffold folds for easy transport. The ladder scaffold may or may not include a safety bar.

14 Claims, 4 Drawing Sheets

LADDER SCAFFOLD

CROSS-REFERENCE TO RELATED APPLICATION

This application claims the benefit of U.S. Provisional Patent Application Ser. No. 60/091,460, filed Jul. 1, 1998.

BACKGROUND OF THE INVENTION

1. Field of the Invention

The present invention relates generally to ladder scaffolds, and particularly to ladder scaffolds suspended from rods inserted through hollow ladder rungs.

2. Description of Related Art

Ladders are well known for use in building construction and repair. Ladders do have certain deficiencies. Ladders provide only a very limited working space. If a ladder is leaning against a wall, any worker standing on the ladder has the ladder as a barrier between himself and the wall. He can reach the wall for only a short distance on either side of the ladder.

Scaffolds provide a platform having much greater working space, but have problems of their own. Adjusting the height of the scaffold is difficult. Climbing up and down the scaffold can be troublesome. Scaffolding is heavy and difficult to move around for jobs at various locations around a building. Scaffolding is also bulky and awkward to transport between jobs.

Pump jacks involve a pair of poles, each long enough to reach to the roof line of a building. A typical pole length would be 40 feet. The top of each pole is attached to the roof line, such as by nailing. A jack on each pole pumps up and down as desired. A platform is supported between the jacks, and its height is adjusted by pumping the jacks. Pump jacks are time consuming to set up. Pump jacks work relatively well for tasks such as putting up siding, where a worker is moving continuously in one direction. Pump jacks do not work well for tasks where a worker is working at just a few different heights. Pump jacks also are not suited for working at about the same height in various locations around a building. The pump jacks must be disassembled and set up again in each new location around the building. Pump jacks are expensive, and also bulky and awkward to transport.

Typical prior art ladder scaffolds attach to the side rails of a pair of ladders and are supported on the outside of the ladders. The ladders are still a barrier between a worker and the wall the ladders lean against. The scaffold also obstructs the ladders, so that the worker cannot easily go up and down past the scaffold. The worker is positioned at some distance from the wall, so that access to the wall itself is still relatively limited. Prior art ladder scaffolds are generally best for working above the roof line of a building, such as for putting on the first few rows of shingles on a roof. Prior art ladder scaffolds are generally complex and have a large number of small parts. The result is that essential parts are easily lost. Assembly and disassembly are time-consuming.

U.S. Pat. No. 3,266,593 by Okie et al. discloses a ladder scaffold made up of three ladder sections, and three ladder brackets connecting the ladder sections. The ladder brackets disclosed by Okie are quite complex. The ladder brackets include a pair of mirror-image bracket sections, each having a plate and two sleeve-like members to hold the side rails of the ladder. The mirror-image bracket sections of each ladder bracket are connected by hinges and a pair of turnbuckles. Each of the bracket sections may be secured to a ladder section by a pin. FIGS. 1 and 2 of Okie show six pins securing the three brackets. The pins may be threaded at each end, and may be inserted through hollow rungs in the ladder sections.

U.S. Pat. No. 3,491,852 by Leist discloses a ladder scaffold having a platform and braces. The platform is supported by hooks fitting into fastening slots in the ladders. The platform braces may have a plurality of regularly spaced holes for adjusting the length.

U.S. Pat. No. 4,941,547 by Livick discloses a ladder scaffold for use against a wall. The platform is supported by a pair of ladder jacks clamped by a U-bolt to the rungs of the ladder. Each ladder jack is a single triangular frame. Each ladder also has an antiflexing brace. The ladder scaffold includes a safety bar attached to the ends of the ladder jacks.

None of the above inventions and patents, taken either singly or in combination, is seen to describe the instant invention as claimed.

SUMMARY OF THE INVENTION

The present invention is a ladder scaffold suspended from rods inserted through the hollow rungs of a ladder. The ladder scaffold includes at least two ladders, at least two platform braces, and a platform. Each platform brace has three rods, two long members, and two short members. Two of the rods are inserted through the hollow rungs of a ladder. The long members are attached to the ends of one of the rods and extend downwards from the ladder. The short members are attached to the ends of the second rod. The short members extend horizontally from the ladder towards the wall or other surface against which the ladder is leaning. The third rod serves as a pivot point between the long members and the short members. The platform is supported by the short members and extends between the ladders. The long and short members can be attached to the rods at various points, so that the platform can be leveled. The ladder scaffold folds for easy transport. The ladder scaffold may or may not include a safety bar.

Accordingly, it is a principal object of the invention to provide a ladder scaffold which is simple, inexpensive, and sturdy, and has relatively few parts.

It is a further object of the invention to provide a ladder scaffold that is easily adjusted to a desired height, easily leveled, easily climbed up to and down from, and does not obstruct the ladders from which it is suspended.

It is another object of the invention to provide a ladder scaffold which has a large working surface and places a worker within easy reach of a large section of the wall or other surface against which the ladders are leaning.

Another object of the invention is to provide a ladder scaffold which can be used with the types of ladders most commonly used in building construction and maintenance.

It is another object of the invention to provide a ladder scaffold which is easily and quickly assembled and disassembled with a minimum of tools, and does not require attachment to a building.

It is a further object of the invention to provide a ladder scaffold which can be moved as a unit without disassembly for tasks being done at the same height at various locations.

Still another object of the invention is to provide a ladder scaffold having a safety bar which is simple and inexpensive; easily attached and removed; and obstructs the ladders to a minimal extent.

It is a further object of the invention to provide a ladder scaffold which is foldable, lightweight, and can be easily transported in a minimum of space.

It is an object of the invention to provide improved elements and arrangements thereof in an apparatus for the purposes described which is dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a ladder scaffold suspended from rods inserted through the hollow rungs of a ladder which is leaning against a wall. The ladder scaffold includes at least two ladders, at least two platform braces, and a platform.

Figure 1:
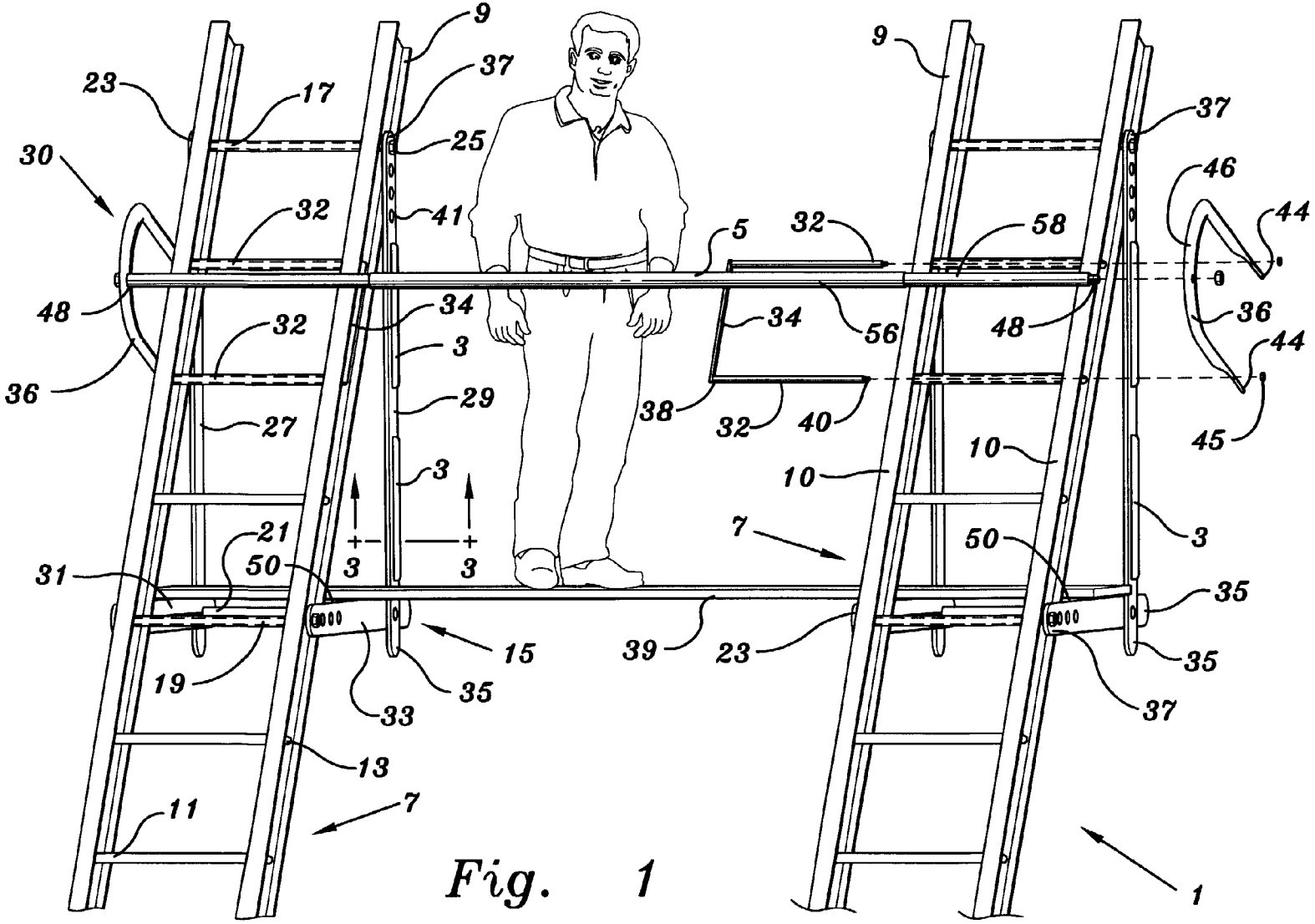
FIG. 1 is an environmental, perspective view of a ladder scaffold according to the present invention, showing the optional reinforcing extensions and optional safety bar.

FIG. 1 is an environmental, perspective view of a ladder scaffold 1 according to the present invention, showing the optional reinforcing extensions 3 and optional safety bar 5. The ladder scaffold 1 includes at least two ladders 7. Each ladder 7 has a top end 9, a bottom end, a pair of side rails 10, and a plurality of hollow rungs 11. The rungs 11 of each ladder 7 have a rung length. Both ends of each rung have an opening 13, so that an object can be inserted all the way through the rung 11.

The ladders 7 are typically leaned against the wall of a building or other generally vertical surface. Other appropriate supporting surfaces may be used, such as a beam or the edge of a roof. Each ladder 7 touches the wall or other supporting surface at or near the top end 9. The bottom of each ladder 7 is some distance away from the wall. Where the ladders are leaning against a wall, preferably the top end 9 of each ladder is placed about two feet above the top of the desired work area. This places the ladder scaffold 1 about one foot away from the wall, which is the most desirable working distance. The ladder scaffold 1 provides a work area having a height of about six or seven feet before the platform height must be adjusted up or down. A worker is therefore within easy reach of a large section of the wall.

The top end 9 may have a rubberized surface or rubber feet to avoid marring the wall. The bottom end may also have feet to avoid sinking into soft soil. The bottom end is preferably about seven feet away from the wall when the ladder scaffold is in use. Preferably each ladder 7 is placed at an angle between about 45 and 60 degrees from the horizontal.

A standard aluminum extension ladder is suitable for each ladder 7. Such ladders are widely used by contractors working around buildings and in the construction industry, and are commonly carried to jobs. With the ladder scaffold 1, a separate set of scaffolding does not have to be taken to a job. Since the ladders 7 would be used anyway, a worker needs to transport only a set of platform braces 15 and a platform 39 in addition to his regular equipment.

The ladder scaffold 1 includes at least two platform braces 15. Each platform brace 15 is releasably attached to one of the ladders 7. The platform braces 15 can be removed from the ladders 7 when a large working surface is not required, for transport, or for other purposes. Each platform brace 15 has at least three rods. The three rods include an upper rod 17, a lower rod 19, and a pivot rod 21. Each of the rods has a first end 23 and a second end 25.

The length of each rod extends from the first end 23 to the second end 25. All of the rods of the same platform brace 15 have an approximately equal length. Preferably all the rods of all the platform braces have an approximately equal rod length. This eliminates mixups between rods of different lengths. Different rod lengths may be used, however, if ladders 7 having different rung lengths are used. If the rod length is long enough, several different rung lengths may be accommodated with one set of rods.

The rod length is longer than the rung length. Preferably the rod length is slightly longer than the rung length. In this case each rod can be inserted through the rung 11 with only a small excess at each end for attaching the brace members. If the attachment is not adjustable for different rung lengths, this may improve the stability by preventing the rods from sliding. A small excess may reduce the chance of a worker knocking into a rod.

The upper rod 17, lower rod 19, and pivot rod 21 may be identical. Alternatively, the pivot rod may be adapted to its hinge function and have a different type of attachment. The pivot rod 21 is preferably permanently attached to the pivot ends 35 of the brace members.

The upper rod 17 passes through a rung 11 of the ladder 7. Preferably the upper rod 17 passes through a rung 11 close to the top end 9 of the ladder 7. Most preferably the upper rod 17 passes through the second rung 11 counting from the top end 9 of the ladder 7. The lower rod 19 passes through a rung 11 of the ladder 7 further from the top end 9 of the ladder 7 than the upper rod 17. Preferably the lower rod 19 is inserted four rungs 11 further from the top end 9, as shown in FIG. 1. This location provides a particularly convenient working position for many tasks.

The ladder scaffold 1 includes at least four brace members. The brace members include a first long member 27, a second long member 29, a first short member 31, and a second short member 33. Each long member 27 and 29 and each short member 31 and 33 have a pivot end 35 and a ladder end 37. The length of each long and short member is from the pivot end 35 to the ladder end 37.

The brace members have a width and a thickness. Preferably the width is about two inches and the thickness is about ¼ inch. Preferably the rod length is about 20 inches, the length of the long members is about 60 inches, and the length of the short members is about 28 inches. Preferably the rods and the brace members are composed of steel or aluminum. Steel is particularly easy to manufacture, but aluminum has advantages in its light weight and lack of corrosion. Composites may also be used. If desired, the pivot ends 35 of the short brace members may include a rubberized surface or a plastic cap to avoid any chance of marring the wall while the ladder scaffold is being positioned.

The ladder scaffold 1 is strong and durable, and can hold virtually any load which the ladders 7 can support. Preferably the ladder scaffold 1 will support two workers and their equipment, or at least 500 pounds.

The first and second ends 23 and 25 of the upper rod 17 are releasably attached to the ladder ends 37 of the first and second long members 27 and 29 respectively. The long members 27 and 29 extend downwards from the upper rod 17 to the pivot rod 21. The first and second ends 23 and 25 of the pivot rod 21 are pivotally attached to the pivot ends 35 of the first and second long members 27 and 29 respectively and to the pivot ends 35 of the first and second short members 31 and 33 respectively.

The short members 31 and 33 extend approximately horizontally from the pivot rod 21 to the lower rod 19. This provides a stable horizontal surface. The short members are preferably perpendicular to the long members. The first and second ends 23 and 25 of the lower rod 19 are releasably attached to the ladder ends 37 of the first and second short members 31 and 33 respectively.

Each of the brace members may or may not include at least one reinforcing extension 3. The reinforcing extension 3 is parallel to the brace member along its length and perpendicular to the brace member along its width. The reinforcing extension 3 increases the strength of the platform brace 15 and helps to prevent swaying.

The ladder scaffold 1 includes at least one platform 39. The platform 39 provides a large working surface. The platform 39 is supported by the platform braces 15. The platform 39 extends between the ladders 7 and rests on top of the short members 31 and 33 of the platform braces 15. The short members 31 and 33 may have a groove (not shown) adjacent to the upper edge 50 to receive the platform 39. Such a groove may help to prevent the platform from sliding, but can limit the width of the platform which can be used. The platform may be attached to the short members if desired, such as by strapping or clips.

The platform should be sufficiently rigid to avoid excessive sagging when the platform 39 is in use. Preferably the platform 39 consists of wooden planks about 10 feet in length. A longer platform 39 provides a larger working surface, but might require more than two ladders 7 for support.

The ladder scaffold 1 is easily adjusted to a desired height. If the ladders 7 are extension ladders, the ladder scaffold 1 may be raised or lowered somewhat by extending or retracting the ladders 7. The platform 39 can then be re-leveled easily by changing the points or openings 41 along the brace members at which the rods attach. The ladder scaffold 1 may also be easily raised or lowered by changing the rungs 11 the rods are attached to.

The ladder scaffold 1 is easily climbed. Access and egress to the platform 39 is unhindered because the platform 39 is suspended beneath the ladders 7 instead of resting on them, thereby permitting the ladder's ordinary use as well as its use as a scaffold support. As seen in FIG. 1, the ladder scaffold 1 does not obstruct the ladders 7; hence, the ladders 7 can also be used simultaneously for different jobs. For example, while the ladder scaffold 1 is in use by a worker for installing a window, the ladders may be used for climbing to the roof. Moreover, no attachment means for securing the ladder scaffold 1 to the building being worked on is required.

The ladder scaffold 1 is especially useful for tasks involving work performed at about the same height over periods of one-half hour or more. Examples include installing windows, building chimneys, reconstruction work, detail painting of buildings, and billboard painting.

The ladder scaffold can be moved as a unit without disassembly for tasks being done at the same height at various locations. For example, a pair of carpenters installing several windows on the second floor of a building can simply move the ladder scaffold as needed, without disassembly. The ladder scaffold is also useful where several similar buildings are being constructed with specific features at the same height, as in tract housing.

Since the ladder scaffold 1 is suspended from the ladders 7, it is inherently safer than the typical prior art ladder scaffold. The workers are within easy reach of the building and are less likely to fall backward or forward. In case of a misstep, one of the ladders 7 is likely to be within reach of the worker. Since the ladder scaffold 1 is inherently safer, a safety bar 5 is not required. Using the ladder scaffold 1 without a safety bar 5 minimizes the number of parts and makes assembly, disassembly, and height adjustment easier and faster.

However, one or more safety bars 5 may be helpful in some circumstances in preventing accidents due to a worker falling off the ladder scaffold 1. The safety bar 5 is particularly useful for working at a considerable height above ground. Alternatively, a safety belt or other safety arrangements may be used for preventing falls from the ladder scaffold 1.

If used, the safety bar 5 may have any of a variety of designs. Preferably each safety bar 5 is attached to the ladders 7 by at least two safety bar braces 30. See FIG. 1. Each of the safety bar braces 30 is releasably attached to one of the ladders 7. One of the safety bar braces 30 is shown attached to the ladder 7 in FIG. 1, another is shown in exploded view. Each safety bar brace 30 has two rods 32, a cross member 34, and an extension member 36.

Each of the rods 32 of the safety bar brace 30 has a connection end 38 and an extension end 40. Each of the rods 32 of the safety bar brace 30 passes through a rung 11 of the ladder 7. Preferably the rods 32 have the same rod length and the same attachment means as the rods of the platform braces 15.

The cross member 34 has two ends. The extension member 36 is preferably U-shaped and extends upwards from the ladder 7 perpendicular to the side rail 10. A rounded shape helps to prevent injuries if a worker should bump into it. The extension member 36 has two ladder ends 44 and a free end 46. Each of the connection ends 38 of the rods 32 of the safety bar brace 30 are attached to one of the ends of the cross member 34. Preferably the cross member 34 and the rods 32 are permanently attached, such as by welding. The cross member 34 preferably has a length corresponding to the distance between two standard adjacent rungs 11.

Each of the extension ends 40 of the rods 32 of the safety bar brace 30 is attached to one of the ladder ends 44 of the extension member 36. See FIG. 1. Preferably the rods 32 and the extension member 36 are releasably attached. Most preferably the extension ends 40 have threads on the exterior, and the extension member 36 is attached by a pair of nuts 45. The length of the extension member 36 extends from the ladder ends 44 to the free end 46. Preferably each extension member 36 is long enough to allow a worker to easily pass between the safety bar 5 and the ladder 7 when ascending or descending the ladder 7. A length of about 1½ feet is acceptable.

The safety bar 5 has two ends 48. Each of the ends 48 of the safety bar 5 is attached to the free end 46 of the extension member 36 of one of the safety bar braces 30. See FIG. 1. Preferably the attachment is releasable. Most preferably the ends 48 have threads on the exterior and the extension member 36 is attached by a nut. The result is that the safety bar 5 extends between the ladders 7. Preferably the safety bar 5 has at least two sections 56 and 58, section 56 having a slightly larger diameter than section 58, as shown in FIG. 1. The length of the safety bar 5 can then be adjusted by telescoping the sections in or out. Preferably the length of the safety bar 5 can be adjusted between about 6 and 10 feet.

The safety bar 5 is simple and inexpensive. It is also easily attached and removed from the ladders 7. The ladder 7 is obstructed only to a minimal extent. At most a worker is required to duck his head when passing between the safety bar and the ladder 7. The entire ladder 7 remains usable. The safety bar 5 is conveniently placed for a worker to grab while moving between the ladder 7 and the ladder scaffold 1. The safety bar 5 and the safety bar braces 30 assemble and disassemble easily.

Figure 2:
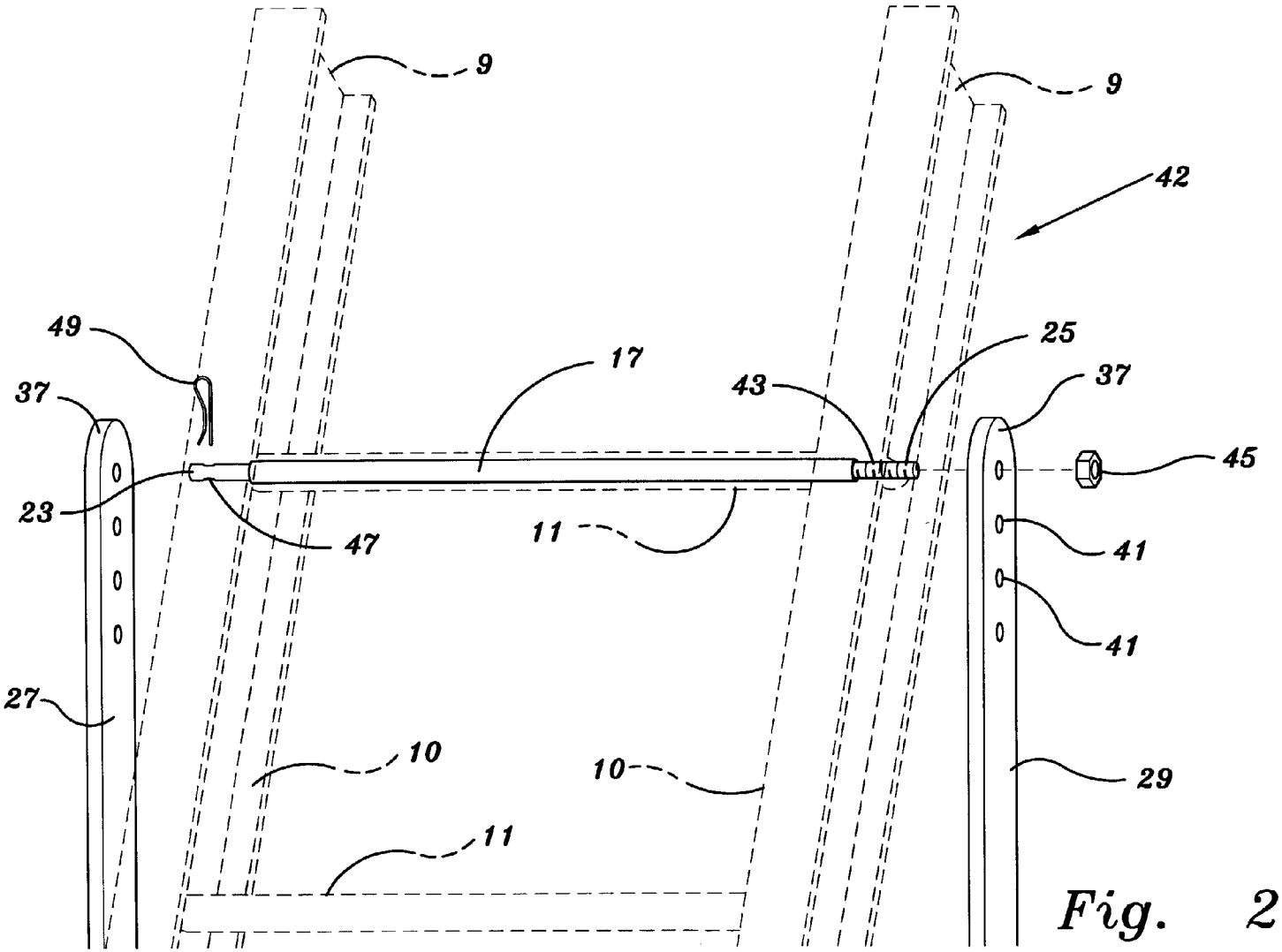
FIG. 2 is a fragmented, exploded detail view of the upper rod of a second embodiment of the invention, showing two types of attachment.

FIG. 2 is a fragmented, exploded detail view of the upper rod of a second embodiment 42 of the ladder scaffold, showing two types of attachment. While each type is shown for only one end of the rod, the opposite end would generally be a mirror image. The long members 27 and 29 of the ladder scaffold 42 do not have a reinforcing extension 3.

Each of the brace members preferably has a series of openings 41 extending from the ladder end 37 of each brace member toward the pivot end 35 of each brace member. Each series includes at least two openings 41. Preferably the series of openings 41 of each of the brace members includes at least four openings. Most preferably the long members 27 and 29 have five openings and the short members 31 and 33 have four openings.

Preferably the openings 41 are spaced about two inches apart along the length of the brace member, starting from the ladder end. The platform 39 can be leveled by attaching the ladder ends 37 of the brace members at the appropriate opening. Two inches between openings is close enough for the necessary flexibility for leveling. Too many holes too close together may weaken the structure.

Each of the openings 41 of the first and second long members 27 and 29 has a size approximately corresponding to the size of the first and second ends 23 and 25 respectively of the upper rod 17. Each of the openings 41 of the first and second short members 31 and 33 has a size approximately corresponding to the size of the first and second ends 23 and 25 respectively of the lower rod 19. The result is that the ends 23 and 25 of the upper and lower rods 17 and 19 pass through the openings 41. The openings 41 should be small enough so that they have no more than a minimal effect on the strength of each brace member.

Instead of a series of openings, other possible leveling means for leveling the platform brace by changing the attachment points are possible. For example, a narrow slot passing through the brace member might be used. The slot would be wide enough for the ends 23 and 25 of the rods to slide back and forth.

The rods may have several different shapes. In one preferred embodiment, the rods are approximately cylindrical in form and have a diameter of about ¾ inch. The rods may also have a square or rectangular cross-section. The ends of the rods may have a shape similar to that of the rod, or different. For example, a cylindrical rod might have an end with a square cross-section, or vice versa. The shape of the openings 41 preferably corresponds to the shape of the end of the appropriate rod. For example, if the end of the rod is cylindrical, the opening 41 is preferably approximately cylindrical in form. This provides a more secure fit and improves the stability of the ladder scaffold 42.

The ladder ends 37 of the brace members are releasably attached to the ends of the rods 23 and 25 by any of various attachment means. Preferably the same attachment means is used for all the rods and brace members of all the platform braces 15. This reduces the number of different parts and avoids confusion. However, different attachment means might be desirable in some circumstances.

In one attachment means, the first and second ends 23 and 25 of the upper and lower rods 17 and 19 have threads 43 on the exterior. The threads 43 are diagrammatically shown for end 25 in FIG. 2. The threads may extend for some distance from the ends 23 and 25 of the rods to allow for adjustment to different rung lengths. Each of the ladder ends of the brace members may attach to the upper and lower rods 17 and 19 by a nut 45. This provides a very secure attachment which is rapidly assembled with only a wrench. Appropriate wrenches are commonly carried to jobs by carpenters and other building workers. A wing nut may be used to simplify attachment further.

An alternative attachment means is shown for end 23 in FIG. 2. In this attachment means, the first and second ends 23 and 25 of the upper and lower rods 17 and 19 each have a pin receiving hole 47. The pin receiving hole extends through the rod. A plurality of pin receiving holes 47 may be regularly spaced along the ends of the rods to adjust for different rung lengths. Each of the ladder ends 37 of the brace members is attached to the upper and lower rods 17 and 19 by a pin 49 passing through the pin receiving hole 47. This attachment means is secure and is very rapidly assembled and disassembled. No tools are required for attachment.

Figure 3:
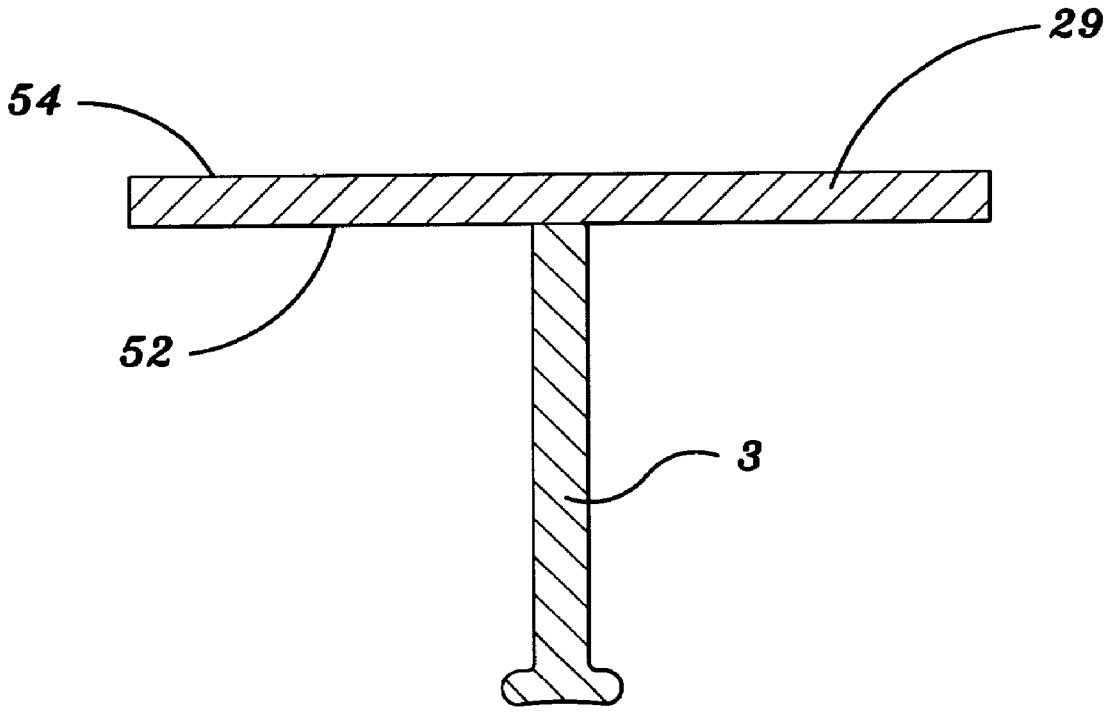
FIG. 3 is a cross-sectional view of a brace member having a reinforcing extension, taken along line 3—3 of FIG. 1.

FIG. 3 is a cross-sectional view of a brace member having a reinforcing extension 3, taken along line 3—3 of FIG. 1. The longitudinal axis of the reinforcing extension 3 is parallel to the long member 29. The reinforcing extension is attached to the brace member along its length. The cross-section of the brace member is approximately a T shape. Preferably the reinforcing extension 3 is integrally attached to the brace member. The reinforcing extension preferably has a length of between ½ and ¾ of the length of the brace member to which it is attached. The height to which the reinforcing extension extends from the brace member preferably ranges from about ¼ the width of the brace member to about the width of the brace member.

Figure 4:
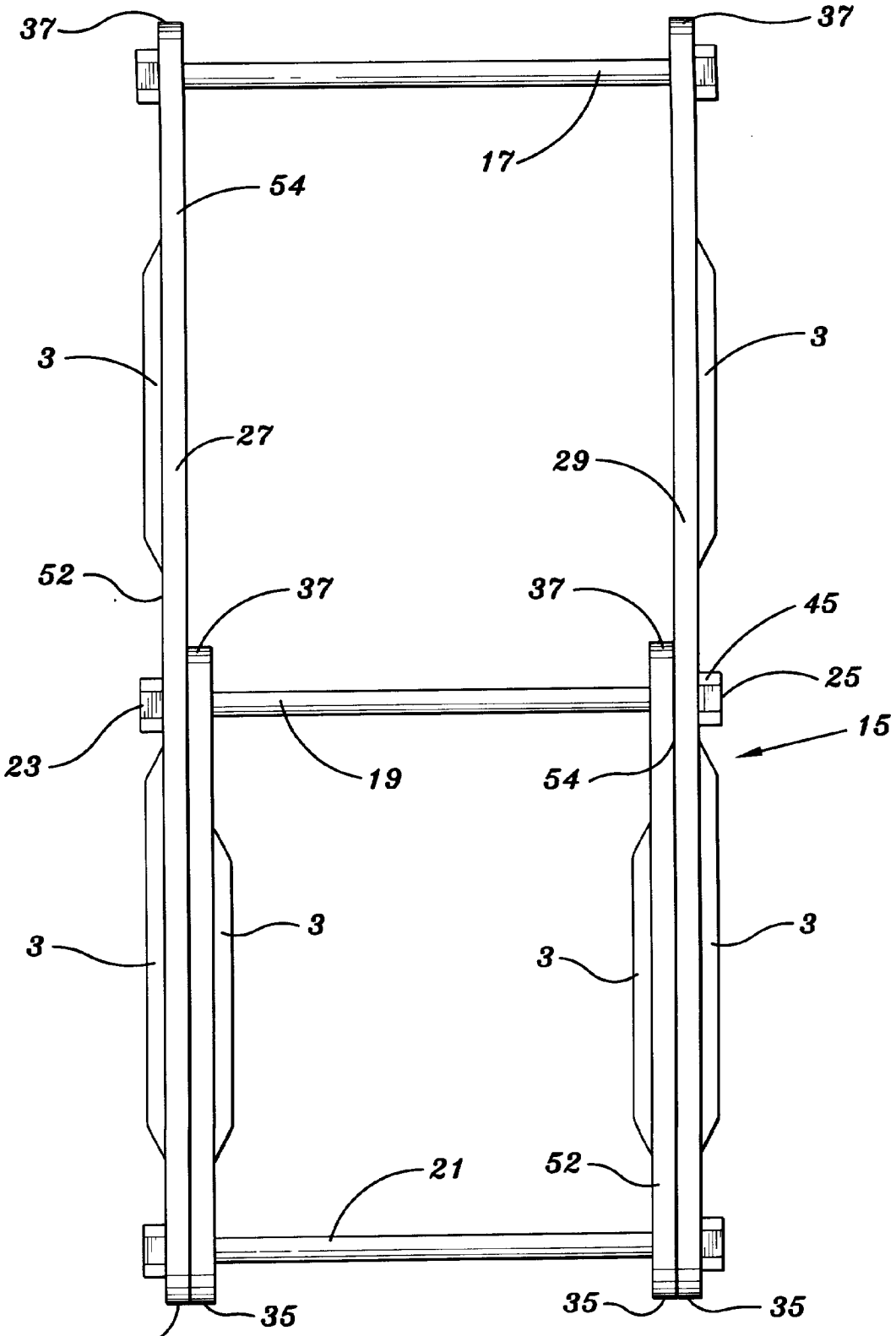
FIG. 4 is a front view of a platform brace folded for storage.

FIG. 4 is a front view of an alternative embodiment of a platform brace 15 folded for storage. Preferably each of the platform braces 15 has a folded position. The platform brace 15 of FIG. 4 has two reinforcing extensions 3 on each long member and one reinforcing extension 3 on each short member. The reinforcing extensions are so arranged that they do not interfere with folding and unfolding the platform brace 15. The reinforcing extension 3 ideally extends from the outer surface 52 of each brace member opposite the side rail of the ladder, as shown in FIGS. 1 and 4. The inner surface 54 contacts the side rail.

The folded position is adapted to storing the platform brace 15. In the folded position, the first and second ends 23 and 25 of the lower rod 19 are releasably attached to the first and second long members 27 and 29 respectively. See FIG. 4. Preferably the lower rod 19 is attached at a distance from the pivot ends 35 of the long members approximately equal to the length of the short members 31 and 33. The lower rod 19 may be attached at any of the series of openings in the short members. Preferably each long member has an opening in the appropriate place. The long members and the short members are approximately parallel in the folded position. In the folded position the entire platform brace 15 forms a neat, compact package. The folded package is only as wide as the brace members and as long as the long members, preferably about 5' by 20" by 2". With the platform braces 15 removed and folded, the entire ladder scaffold takes up only a minimal space in a pickup truck. The compact shape can be easily fitted in with other items. The ladder scaffold is much lighter and less bulky to transport than conventional scaffolding or prior art ladder scaffolds.

Preferably all the rods and nuts or pins are attached in the folded position. This helps to prevent loss of parts in storage or transport. Since the rods and the brace members are secured together, they cannot flop around or damage other items during transport.

Alternatively, each platform brace 15 may be transported attached to a ladder 7. The upper rod 17 remains in place. The lower rod 19 would be extended downward until the long and short members were approximately parallel. The lower rod 19 would then be attached to an appropriate rung 11. This arrangement makes assembly of the ladder scaffold extremely fast, since only the lower rod would have to be moved.

The ladder scaffold of the present invention is simple, inexpensive, sturdy, and easy to manufacture. The ladder scaffold has relatively few parts total, only about 11 parts per platform brace. Of these, several parts are partially or completely interchangeable, so that there are only about 4 different parts per platform brace. This simplifies both manufacture and assembly of the ladder scaffold.

The number of connections made during assembly of the ladder scaffold is relatively small, preferably four or less per platform brace. With this small number, it is easy to be sure that all of the connections are secure. The result is fewer opportunities for errors and less chance of the ladder scaffold coming apart in use.

It is to be understood that the present invention is not limited to the sole embodiments described above, but encompasses any and all embodiments within the scope of the following claims.

What is claimed is:

1. A ladder scaffold comprising:

(a) at least two ladders, each ladder having a top end and a plurality of hollow rungs, the rungs of each ladder having a rung length;

(b) at least two platform braces, each platform brace being releasably attached to one of the ladders, each platform brace having (i) at least three rods, the three rods including an upper rod, a lower rod, and a pivot rod, each of the rods having a first end, a second end, and a rod length extending from the first end to the second end, the rods having an approximately equal rod length, the rod length being longer than the rung length, the upper rod passing through a rung of the ladder, the lower rod passing through a rung of the ladder farther from the top end of the ladder than the upper rod; and (ii) at least four brace members, the brace members including a first long member, a second long member, a first short member, and a second short member, each long member and each short member having a pivot end, a ladder end, and a length extending from the pivot end to the ladder end, the first and second ends of the upper rod being releasably attached to the ladder ends of the first and second long members respectively, the long members extending downwards from the upper rod to the pivot rod, the first and second ends of the pivot rod being pivotally attached to the pivot ends of the first and second long members respectively and to the pivot ends of the first and second short members respectively, the short members extending approximately horizontally from the pivot rod to the lower rod, the first and second ends of the lower rod being releasably attached to the ladder ends of the first and second short members respectively;

(c) at least one platform, the platform being supported by the platform braces, the platform extending between the ladders;

(d) at least two safety bar braces, each of the safety bar braces being releasably attached to one of the ladders, each safety bar brace having two rods, a cross member, and an extension member, each of the rods of the safety bar brace having a connection end and an extension end, each of the rods of the safety bar brace passing through a rung of the ladder, the cross member having two ends, the extension member being U-shaped and extending upwards from the ladder, the extension member having two ladder ends and a free end, each of the connection ends of the rods of the safety bar brace being attached to one of the ends of the cross member, each of the extension ends of the rods of the safety bar brace being attached to one of the ladder ends of the extension member; and (e) at least one safety bar, the safety bar having two ends, each of the ends of the safety bar being attached to the free end of the extension member of one of the safety bar braces, so that the safety bar extends between the ladders;

wherein each of the brace members has a series of openings extending from the ladder end of each brace member toward the pivot end of each brace member, the series including at least two openings, each of the openings of the first and second long members having a size approximately corresponding to the size of the first and second ends respectively of the upper rod, each of the openings of the first and second short members having a size approximately corresponding to the size of the first and second ends respectively of the lower rod, so that the ends of the upper and lower rods pass through the openings.

2. The ladder scaffold according to claim 1, wherein each of the first and second ends of the upper and lower rods have threads, and each of the ladder ends of the brace members is attached by a nut.

3. The ladder scaffold according to claim 1, wherein at least one of the first and second ends of at least one of the upper and lower rods has at least one pin receiving hole, and at least one of the ladder ends of the brace members is attached by a pin passing through the pin receiving hole.

4. The ladder scaffold according to claim 1, wherein the rods are approximately cylindrical in form and have a diameter of about ¾ inch, and the openings are approximately cylindrical in form.

5. The ladder scaffold according to claim 1, wherein the series of openings of each of the brace members includes at least four openings, and the openings are spaced about two inches apart along the length of the brace member.

6. The ladder scaffold according to claim 1, wherein the safety bar has at least two telescoping sections.

7. The ladder scaffold according to claim 1, wherein each of the ladders includes two side rails, and each safety bar brace extends perpendicular to one of the side rails.

8. The ladder scaffold according to claim 1, wherein at least one of the brace members includes a reinforcing extension.

9. The ladder scaffold according to claim 8, wherein the at least one brace member has an outer surface, the reinforcing extension is attached to the outer surface of the at least one brace member, and the at least one brace member is T-shaped in cross section.

10. The ladder scaffold according to claim 8, wherein each of the brace members includes at least one reinforcing extension.

11. The ladder scaffold according to claim 1, wherein each of the platform braces has a folded position, the folded position is adapted to storing the platform brace, the first and second ends of the lower rod in the folded position are releasably attached to the first and second long members respectively, and the long members and the short members are approximately parallel.

12. The ladder scaffold according to claim 1, wherein the brace members have a width and a thickness, the width of the brace members is about two inches, and the thickness of the brace members is about ¼ inch.

13. The ladder scaffold according to claim 1, wherein the rod length is about 20 inches, the length of the long members is about 60 inches, and the length of the short members is about 28 inches.

14. The ladder scaffold according to claim 1, wherein the rods and the brace members are composed of a material selected from the group consisting of steel and aluminum.

* * * * *